US005259606A

United States Patent [19]

Takahashi

[11] Patent Number: 5,259,606

[45] Date of Patent: Nov. 9, 1993

[54] SHEET FEEDING DEVICE FOR IMAGE FORMING EQUIPMENT

[75] Inventor: Yasuhiro Takahashi, Tokyo, Japan

[73] Assignee: Ricoh Company, Ltd., Tokyo, Japan

[21] Appl. No.: 943,989

[22] Filed: Sep. 11, 1992

Related U.S. Application Data

[63] Continuation of Ser. No. 755,839, Sep. 6, 1991, abandoned.

[30] Foreign Application Priority Data

Sep. 6, 1990 [JP] Japan ..... 2-234385

[51] Int. Cl.[5] ..... B65H 3/44; B65H 5/00

[52] U.S. Cl. ..... 271/9; 271/225; 271/185

[58] Field of Search ..... 271/9, 184, 185, 225

[56] References Cited

U.S. PATENT DOCUMENTS

| | | | |
|---|---|---|---|
| 4,669,719 | 6/1987 | Fratangelo | 271/185 |
| 4,949,949 | 8/1990 | Holmes et al. | 271/225 |
| 4,958,828 | 9/1990 | Saito | 271/225 |
| 5,052,671 | 10/1991 | Matsuo | 271/9 |
| 5,056,772 | 10/1991 | Kellum, III | 271/225 |
| 5,102,112 | 4/1992 | Takahashi | 271/9 |

FOREIGN PATENT DOCUMENTS

| | | | |
|---|---|---|---|
| 75749 | 4/1986 | Japan | 271/9 |
| 138031 | 5/1990 | Japan | 271/9 |
| 204237 | 8/1990 | Japan | 271/9 |

*Primary Examiner*—Robert P. Olszewski
*Assistant Examiner*—Steven M. Reiss
*Attorney, Agent, or Firm*—Oblon, Spivak, McClelland, Maier & Neustadt

[57] ABSTRACT

A sheet feeding device for image forming equipment and having a sheet position changing mechanism for changing the orientation of a sheet being fed from a sheet storing section toward an image forming station defined in the equipment by 90 degrees in the horizontal direction. The sheet position changing mechanism is combined with a tandem arrangement of two or more sheet storing sections to enhance the functions available with each sheet storing section.

3 Claims, 5 Drawing Sheets

SHEET FEEDING DEVICE FOR IMAGE FORMING EQUIPMENT

This application is a continuation of application Ser. No. 07/755,839, filed on Sep. 6, 1991, now abandoned.

BACKGROUND OF THE INVENTION

The present invention relates to a copier, facsimile apparatus, printer or similar image forming equipment and, more particularly, to a sheet feeding device having a mechanism for changing the position or orientation of a sheet being transported from a sheet storing section included in the device toward an image forming section included in the equipment by 90 degrees.

There has been proposed a sheet position changing mechanism capable of changing the orientation of a sheet fed out from a sheet storing section by 90 degrees in the horizontal direction before the sheet reaches an image forming station as mentioned above. With such a device, it is possible to transport a sheet accommodated longitudinally in the intended direction, i.e., in the plane of the sheet surface, of sheet feed in a sheet storing section sideways, i.e. , in the same orientation as a sheet accommodated laterally in a sheet storing section, or vice versa. The sheet position changing device, therefore, allows a single sheet storing section to replace conventional two exclusive sheet storing section which are respectively loaded with a sheet stack in a lateral position and a sheet stack in a longitudinal position, so long as the two sheet stacks are of the same size. There has also been proposed a sheet feeding device having a plurality of horizontal sheet storing sections arranged in a tandem configuration, as disclosed in, for example, Japanese Patent Laid-Open Publication No. 86326/1986.

The two kinds of conventional devices described above enhance the functions available with each of the sheet storing sections arranged one above another and, at the same time, save the space for installation and cost. However, when each of the two devices in used alone, the advantages available therewith are limited.

SUMMARY OF THE INVENTION

It is, therefore, an object of the present invention to provide a sheet feeding device for image forming equipment in which a sheet position changing device and a tandem sheet feeding device are combined to further enhance the functions available with each sheet storing section while further saving the space of installation and cost.

It is another object of the present invention to provide a generally improved sheet feeding device for image forming equipment.

A sheet feeding device for image forming equipment of the present invention comprises a plurality of sheet storing sections for storing sheets, a sheet position changing unit for changing the position of a sheet being fed from any one of the sheet storing sections toward an image forming station defined in the image forming equipment by substantially 90 degrees in a horizontal direction, i.e., about an axis substantially normal to the surface of the sheet, a sheet pick-up roller and a sheet separation roller pair located at the same side of the sheet storing sections as each other, a first transport path for transporting a sheet from the sheet storing sections to the image forming station, and a second transport path extending from at least one of the sheet storing sections to the sheet position changing unit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
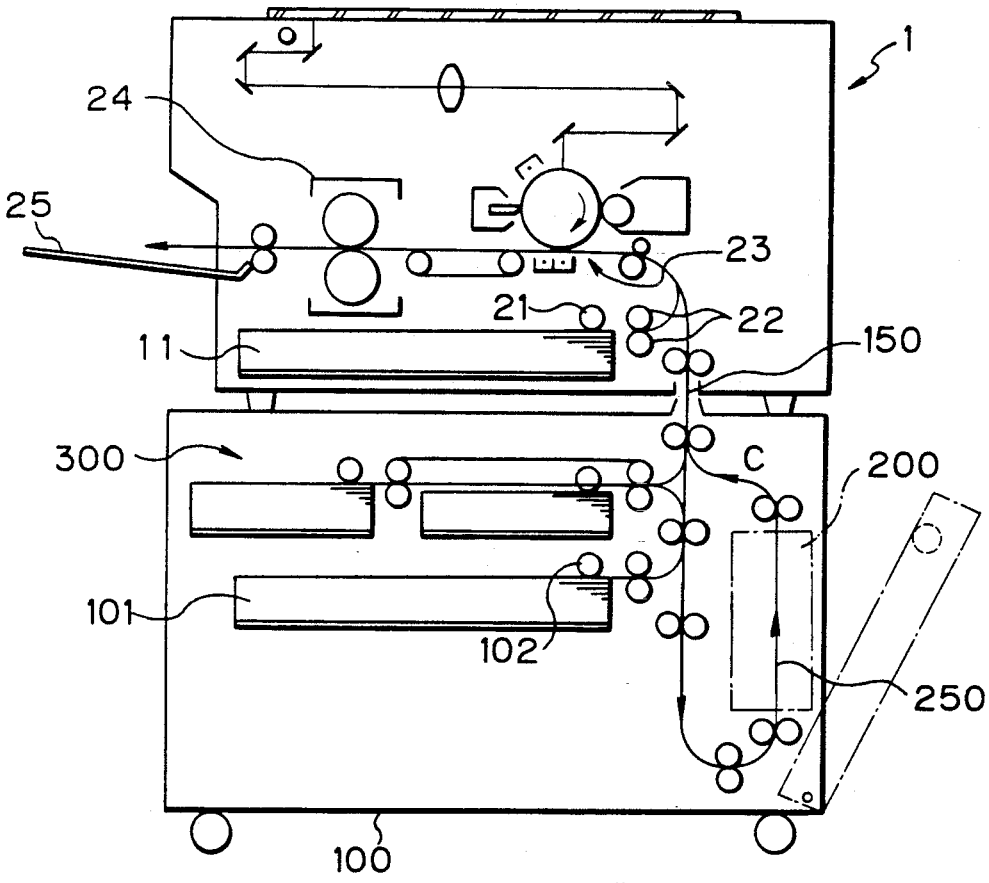
FIG. 1 is a section showing image forming equipment with a sheet feeding device embodying the present invention and implemented as a copier.

Referring to FIG. 1 of the drawings, image forming equipment with a sheet feeding device embodying the present invention is shown and implemented as a copier by way of example. As shown, the copier, generally 1, is mounted on the body of a sheet feeding device 100. Another sheet feeding device independent of the device 100 is built in the body of the copier 1. Specifically, the sheet feeding device incorporated in the copier body 1 has a sheet storing section loaded with a stack of sheets 11, a pick-up roller 21, and a separation roller pair 22. A sheet 11 fed out from the sheet storing section by the pick-up roller 21 is routed to an image transfer station 23 via the separation roller pair 22. After an image has been transferred to the sheet 11 at the station 23, the sheet 11 is driven out of the copier body to a tray 25 via a fixing device 24. The sheet feeding device 100 underlying the copier 1 has a plurality of sheet storing sections, and a sheet position changing mechanism or unit 200 for rotating a sheet 90 degrees in the horizontal direction. Assume that a sheet is not rotated by the sheet position changing unit 200. Then, a sheet fed from, for example, a stack 101 loaded on one of the sheet storing sections by a pick-up roller 102 is transported to the image transfer station 23 along a vertical transport path 150 which communicates with the copier body 1. This is also true with the other sheet stacks accommodated in the sheet feeding device 100. Specifically, a plurality of sheet storing sections are arranged substantially horizontally adjacent and in parallel to each other in the sheet feeding device 100 and at the same vertical level such that they do not overlap, constituting a tandem sheet feeding section 300.

Figure 2:
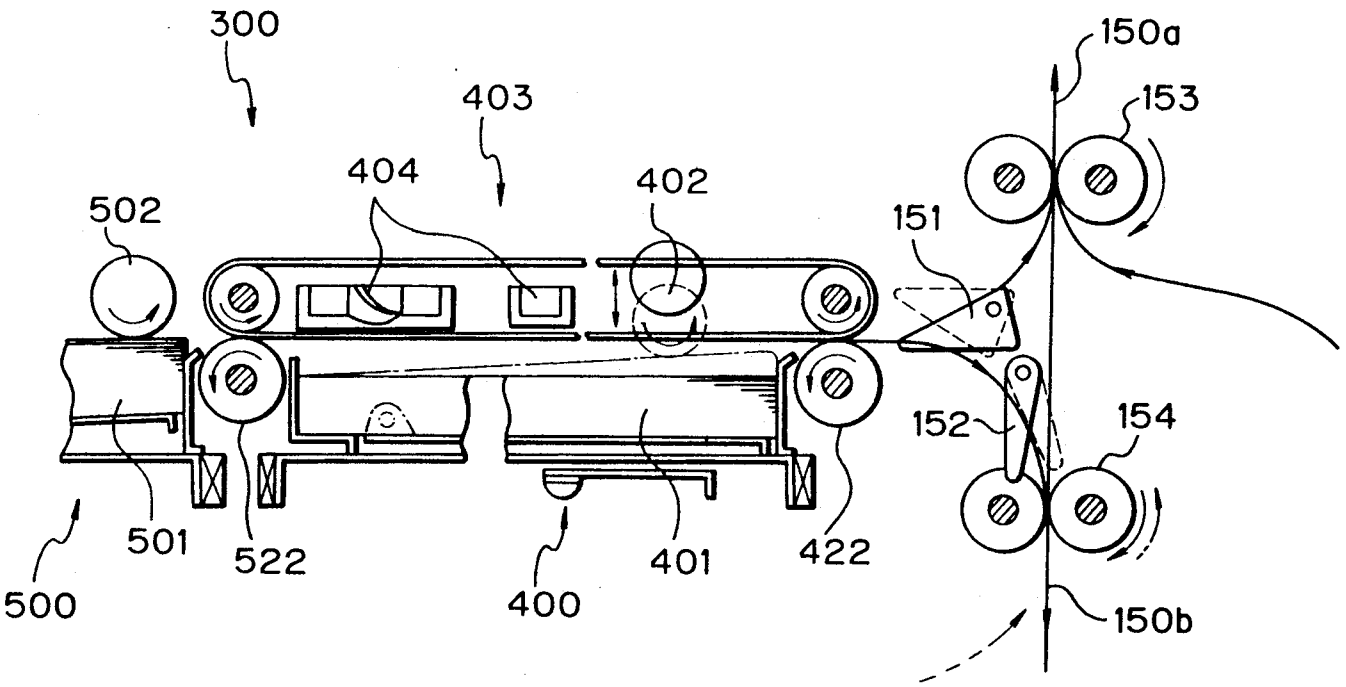
FIG. 2 is a fragmentary section of the embodiment.

As shown in FIG. 2, the tandem sheet feeding section 300 has a first and a second sheet storing section 400 and 500, respectively. The sheet feeding section 300 has an overall length which is almost the same as the length of the other storing sections, i.e., the storing section loaded with the sheet stack 101. There are shown in FIG. 2 sheet stacks 401 and 501, pick-up rollers 402 and 502, fans 404 for sucking a sheet onto the surface of a belt 403, and separation roller pairs 422 and 522.

Figure 10:
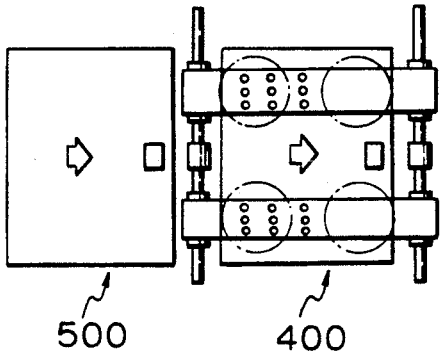
FIG. 10 is a plan view of a transport belt applicable to any of the illustrative embodiments of the present invention.

Assume that a sheet is fed out from the stack 501 accommodated in the second sheet storing section 500. The sheet fed out from the sheet stack 501 by the pick-up roller 502 is separated from the others by the separation roller pair 522 and then transported by the belt 403 to the separation roller 422 of the first sheet storing section 400 by being retained on the belt 403 due to suction. Subsequently, this sheet is routed through a first transport path 150*a* via a transport roller group 153. While the second sheet storing section 500 is in use, the pick-up roller 402 of the first sheet storing section 400 is raised to an inoperative position so as not the interfere with the above-mentioned sheet. The belt 403 is implemented as a plurality of relatively wide, flat perforated belts (see FIG. 10).

How the sheet position changing unit 200 changes the orientation of a sheet by 90 degrees will be described. Assume that a sheet coming in the device 200 is long in the lateral direction and should be reoriented to be long in the longitudinal direction by the device 200. Selectors in the form of pawls 151 and 152 and a reversible transport roller group 154 are located downstream of the pick-up roller 402 with respect to the intended direction of sheet feed. In this case, the selectors 151 and 152 and transport roller group 154 are so operated to steer a sheet toward the sheet position changing unit 200. The selectors 151 and 152 are associated with each sheet storing section having the above construction, and each is usually held in a position indicated by a solid line in the figure. To steer a sheet toward the sheet position changing unit 200, the selectors 151 and 152 are each brought to a position indicated by a phantom line. The reversible roller group 154 is rotated in a particular direction for driving a sheet toward the device 200. Although the unit 200 may be located in any position in the device body 100, locating it at the opposite side to the sheet storing sections with respect to the vertical transport path is desirable from the compactness standpoint and to facilitate the removal of a jamming sheet. In the illustrative embodiment, the sheet of interest is first turned over at the lower portion of the device body 100, driven into the device 200 and bodily rotated therein, and then driven out of the device 200 in a direction C.

In FIG. 2, the transport path 150*a* directly extends into the copier body 1, while a second transport path 150*b* extends to the sheet position changing unit 200.

FIGS. 3 through 6 show a specific construction of the sheet position changing unit 200. A sheet enters the device 200 in a direction indicated by an arrow B in FIG. 3. An inlet roller pair 201 drives the incoming sheet into a rotation and transport path 250, FIG. 1, which is defined by a guide base 202 and an upper guide plate 203. Arranged on the rotation and transport path 250 are a side fence 204, a feed roller 205, a shift roller 206, a stop 209, and a bladed wheel 210. The side fence 204 is moved to and held at a particular position matching the sheet size by moving means. The feed roller 205 drives the sheet in the direction in which the sheet is advancing, while the shift roller 206 shifts the rotated sheet until the latter abuts against the side fence 204. The stop 209 positions the leading edge of the sheet before the sheet is rotated. The bladed wheel 210 causes the sheet to rotate about the axis thereof.

Figure 6:
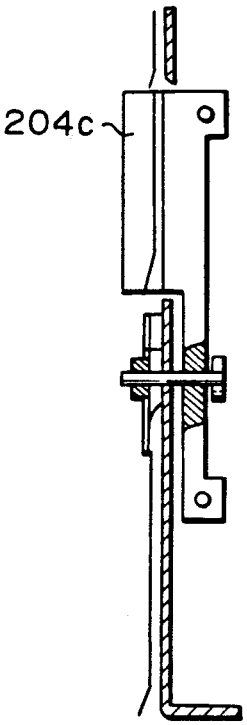
FIG. 6 is a side elevation of the sheet position changing device.
Figure 7:
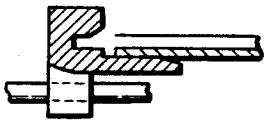
FIG. 7 is a section along line Y—Y of FIG. 5.

The side fence 204 is usually located in a home position thereof which is determined by a home sensor 208. Before the sheet enters the sheet position changing unit 200, the side fence 204 is driven by a stepping motor 207 to a predetermined restricting position. When a sheet is transported with the center thereof used as a reference, a position which is a/2 (a being the dimension of the shorter side of the sheet) spaced away from the center line is selected to be the restricting position. The longer side of the sheet has a dimension b. The dimension a/2 is represented by d in the figure. The side fence 204 extends in the transport direction and serves as a positioning surface when the sheet is rotated. After the rotation of the sheet, the side fence 204 guides the sheet in the transport direction. As shown in FIG. 6, the side fence 204 is provided with a guide 204*c* for positioning the sheet in a direction perpendicular to the guide surface. The guide 204*c* may be replaced with a flexible film, wire, leaf spring or similar member.

The bladed wheel 210 is located upstream of the side fence 204 and downstream of the feed roller 205. The bladed wheel 210 is rotatable about a shaft 210*c* in a direction indicated by an arrow in the figures. The shaft 210*c* is positioned substantially on the extension of the reference surface of the side fence 204. Arms 210*a* extend radially outward from the shaft 210*c* of the bladed wheel 210, and each carries a plurality of blades 210*b* which have an adequate elasticity and exert an adequate degree of frictional force. When the blades 210*b* are positioned in a notch 203*a* formed in the upper guide plate 203, they press themselves against the sheet having been positioned on the transport path. As a result, the sheet is rotated about 90 degrees about the shaft 210*c* of the bladed wheel 210 until the leading edge thereof abuts against the side fence 204. Thereafter, the blades 210*b* are retracted sideways from the transport path while sliding on the sheet. Assuming that the bladed wheel 210*b* rotates at a peripheral speed Va, and that the feed roller 205 feeds the sheet at a rate Vb, then the following equation should preferably be satisfied:

$$Vb = \frac{1}{c} rVa$$

where r and c are respectively the radius of rotation of the bladed wheel 210*b* and the distance between the feed roller 205 and the center of rotation.

A blade raising portion 203*b* is positioned in close proximity to the notch 203*a* of the upper guide plate 203 so as to raise the blades 210*b* contacting the transport path 203*b* onto the upper guide plate 203. The blades 210*b* may be implemented as elastic pieces made of rubber such as soft urethane rubber or soft foam urethane rubber or elastic films having adequate frictional members provided thereon by adhesion or coating. The degree of friction is selected such that after the sheet has abutted against the side fence 204, the blades 210*b* do not bend or crease the side edge of the sheet.

Before the trailing edge of the sheet having entered the device 200 moves away from the inlet roller pair 201, the sheet is handed over to the feed roller 205. Since the shaft 210*c* of the bladed wheel 210 and a tiltable stop 209 are positioned side by side in a direction perpendicular to the transport direction, the leading edge of the incoming sheet is positioned first. To allow the roller 205 to slip when the sheet is held in contact with the shaft 210*c* and stop 209, a torque limiter may be incorporated in the drive side of the roller 205 or the driven side may be implemented as a ball. After the leading edge of the sheet has been so positioned, the stop 209 is released from the sheet on the elapse of a predetermined period of time. As a result, a moment of rotation acts on the sheet about the shaft 210*c* of the bladed wheel 210. This, coupled with the fact that the blades 210*b* press against the sheet, causes the sheet to sequentially rotate in the plane of its surface, i.e., about an axis normal to its surface, as indicated by successive positions $P_1$, $P_2$ and $P_3$. Then, the sheet is handed over to the shift roller 206 with the result that the longer edge thereof is positioned by the side fence 204. The shift roller 206, like the feed roller 205, may have the driven side thereof implemented as a ball and may advantageously be inclined by an angle $\theta$ relative to the transport direction. The angle $\theta$ is selected to be 5 degrees to 30 degrees. After the rotation, the sheet is driven along the side fence 204 and then forced out of the device 200 by an outlet roller pair 211 in the direction C.

Since the bladed wheel 210 is rotatable integrally with the side fence 204 in a direction perpendicular to the transport direction, it can adapt itself to various sheet sizes (see FIG. 6). The arms 210*a* each may carry one blade or two or more blades, as desired. The configuration of each blade is open to choice.

While the embodiment stops the movement of the sheet by the stop 209 and then rotates the sheet, it may be so modified as to rotate the sheet without stopping it to thereby omit the stop 209.

Figure 4:
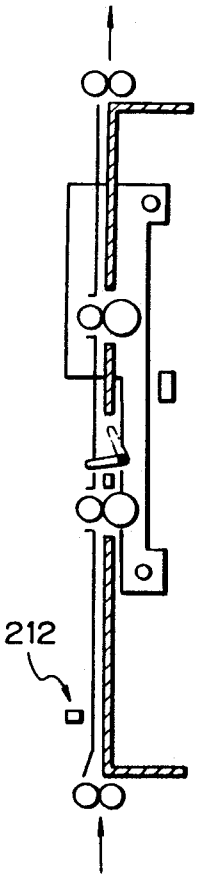
FIG. 4 is a section along line X—X of FIG. 3.
Figure 3:
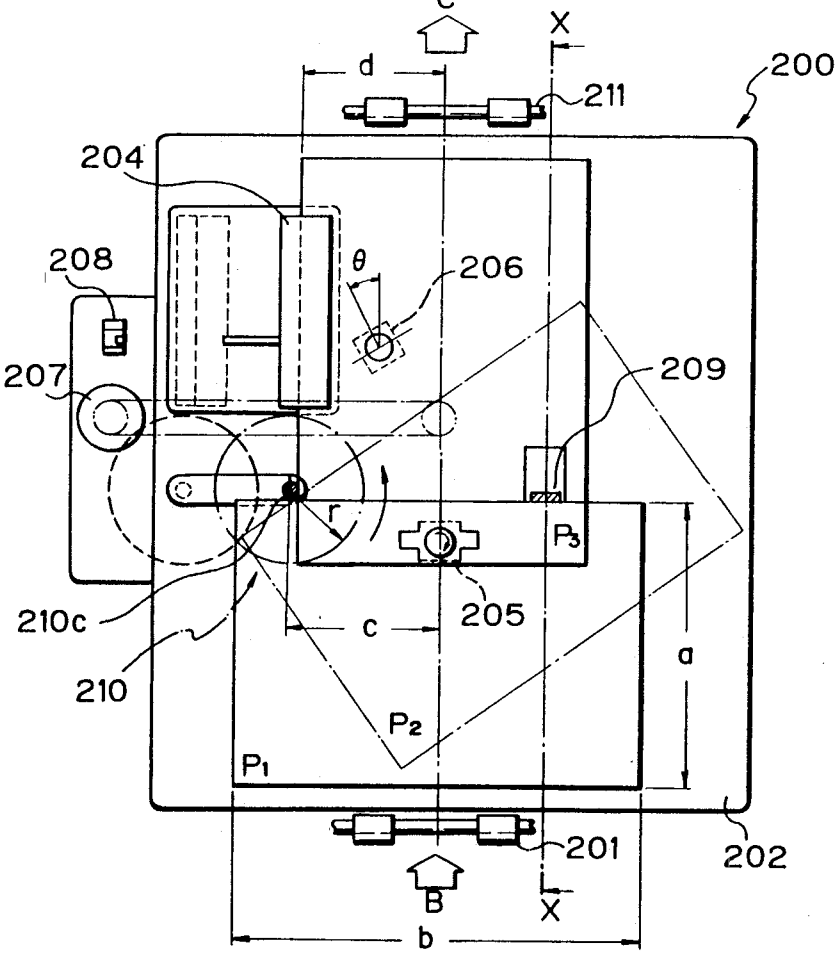
FIG. 3 is a plan view of a sheet position changing device included in the embodiment.
Figure 5:
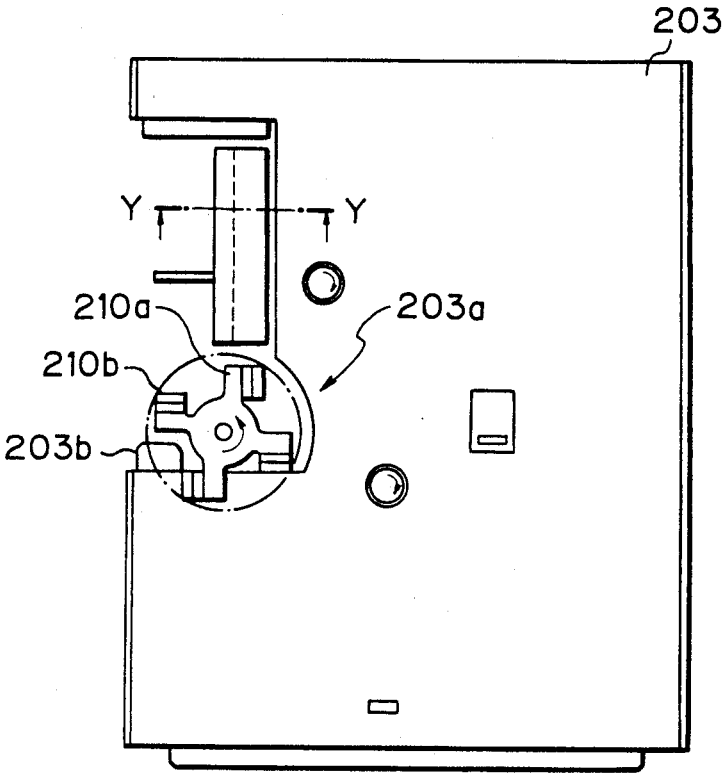
FIG. 5 is a plan view of an upper guide plate forming part of the sheet position changing device.

An arrangement may be made such that, in FIG. 5, the blades 210*b* are pressed against the sheet while the sheet is stopped by the stop 209, and then the stop 209 is immediately released to rotate the sheet. In such a case, a sheet sensor 212, FIG. 4, is located on the transport path, and the blades 210*b* are rotated intermittently by a stepping motor or similar drive source. That is, the rotation of the blades 210*b* is controlled in relation to the position of the sheet. More specifically, the blades 210*b* are retracted to the top of the upper guide plate 203 until the sheet reaches the stop 209. When the sheet reaches the stop 209, the blades 210*a* are driven into pressing contact with the sheet and, at the same time, the stop 209 is released to rotate the sheet 90 degrees.

The belt 403 for transporting the sheet fed out from the second storing section 500 may be replaced with any other conventional transporting means. Regarding the tandem sheet feeding section 300, is will be most effective from the usage and processing ability standpoint that sheets of relatively small sizes such as A4 and A5 be loaded sideways and steered 90 degrees afterwards, as needed. The tandem sheet feeding section 300 combined with the 90 degrees rotating unit 200 is comparable in function with the conventional 4-step sheet feed configuration. For example, assume that a conventional 4-step sheet feeding arrangement has a sheet storing section loaded with A4 sheets in a lateral orientation, a sheet storing section loaded with A4 sheets in a longitudinal orientation, a sheet storing section loaded with B5 sheets in a lateral orientation, and a sheet storing section loaded with B5 sheets in a longitudinal orientation. Then, if the first storing section 400 and the second storing section 500 are respectively loaded with A4 sheets sideways and B5 sheets sideways, the tandem sheet feeding section 300 is identical with the conventional four-step configuration as to the function.

Figure 8:
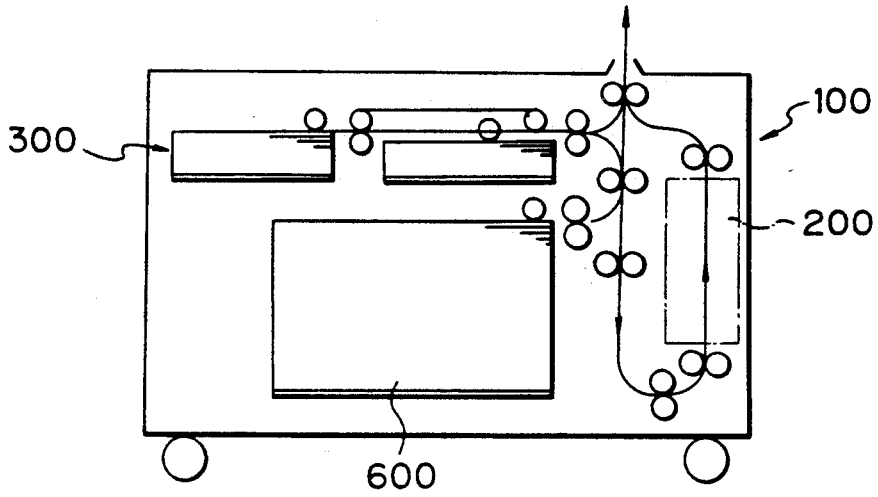
FIGS. 8 and 9 are sections each showing an alternative embodiment of the present invention.
Figure 9:
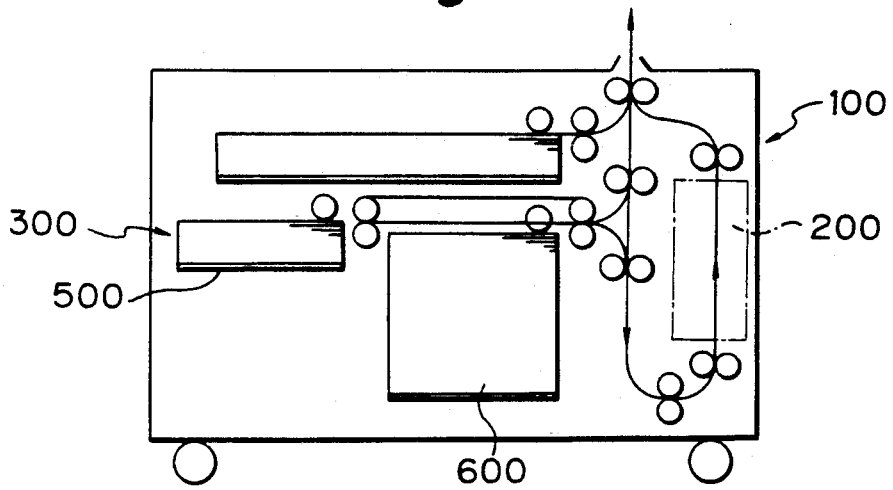

FIGS. 8 and 9 each shows an alternative embodiment of the present invention. Specifically, FIG. 8 shows an embodiment wherein the lower step of the tandem sheet feeding section 300 is implemented as a mass storage or tray 600, while FIG. 9 shows an embodiment wherein the front step of the tandem sheet feeding section 300 is implemented as a mass storage or tray 600.

In summary, in accordance with the present invention, a tandem arrangement of horizontal sheet storing sections and a sheet position changing mechanism are combined to double the functions available with sheet storing sections. This is successful in saving space and cost.

Since the sheet storing sections each feeds sheets sideways, not only sheets of relatively small sizes which are fed sideways and used more often than the others are processed efficiently, but also the lateral dimension of the machine is not increased. Hence, the effective use of a limited space is promoted.

Moreover, a first and a second transport path are implemented as a single transport path shared by the plurality of sheet storing sections, simplifying the construction.

Various modifications will become possible for those skilled in the art after receiving the teachings of the present disclosure without departing from the scope thereof.

What is claimed is:

1. A sheet feeding device for image forming equipment, comprising:

a plurality of sheet storing means for storing sheets having lengths greater than widths, said sheet storing means being arranged horizontally adjacent to one another and at substantially the same vertical level such that said sheet storing means do not overlap one another;

sheet position changing means for changing the position of a sheet being fed from any one of said sheet storing means toward an image forming station defined in said image forming equipment by substantially 90 degrees about an axis substantially normal to the surface of the sheet;

sheet pick-up means and sheet separating means located at the same side of said sheet storing means as each other;

first transport path means for transporting a sheet in a first transport path from said sheet storing means to said image forming station; and second transport path means extending in a second transport path from at least one of said sheet storing means to said sheet position changing means, wherein said sheet storing means comprise means for storing sheets with the lengths of the sheets extending transverse to the second transport path.

2. A device as claimed in claim 1, wherein said first and second transport path means each comprise a single transport path shared by said plurality of sheet storing means.

3. The sheet feeding device of claim 1, further comprising:

a further sheet storing means for storing sheets having lengths greater than widths, said further sheet storing means being vertically spaced from, and overlapping, said plurality of sheet storing means; and third transport path means for transporting a sheet in a third transport path from said further sheet storing means to said image forming station, wherein said further sheet storing means comprise means for storing sheets with the lengths of the sheets extending parallel to the third transport path.

* * * * *